US009157704B2

(12) United States Patent
Bayer et al.

(10) Patent No.: US 9,157,704 B2
(45) Date of Patent: Oct. 13, 2015

(54) VEHICLE FLOOR PAN COMPRISING AUXILIARY ARMORING

(75) Inventors: Robert Bayer, Munich (DE); Christian Schwippl, Munich (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 157 days.

(21) Appl. No.: 13/643,075

(22) PCT Filed: Apr. 15, 2011

(86) PCT No.: PCT/DE2011/075081

§ 371 (c)(1),
(2), (4) Date: Nov. 25, 2012

(87) PCT Pub. No.: WO2011/131184

PCT Pub. Date: Oct. 27, 2011

(65) Prior Publication Data

US 2013/0205981 A1 Aug. 15, 2013

(30) Foreign Application Priority Data

Apr. 23, 2010 (DE) ..... 10 2010 016 605

(51) Int. Cl.

| | |
|---|---|
| ***F41H 7/00*** | (2006.01) |
| ***F41H 7/04*** | (2006.01) |
| ***F41H 5/013*** | (2006.01) |
| ***F41H 5/04*** | (2006.01) |

(52) U.S. Cl.

CPC ..... *F41H 7/042* (2013.01); *F41H 5/013* (2013.01); *F41H 5/04* (2013.01)

(58) Field of Classification Search

CPC ..... F41H 5/013; F41H 7/042; F41H 7/044
USPC ..... 89/36.02, 36.07, 36.08, 36.09, 36.11; 296/187.08, 193.07; 280/770
See application file for complete search history.

(56) References Cited

U.S. PATENT DOCUMENTS

| | | | | |
|---|---|---|---|---|
| 4,167,889 | A | 9/1979 | Bohne et al. | |
| 5,747,721 | A * | 5/1998 | Speakes et al. | 89/36.11 |
| 6,658,984 | B2 * | 12/2003 | Zonak | 296/193.07 |
| 7,255,034 | B2 * | 8/2007 | Strassgurtl et al. | 296/193.07 |
| 8,267,003 | B1 * | 9/2012 | Lou et al. | 89/36.08 |
| 8,413,567 | B2 * | 4/2013 | Luther et al. | 89/36.08 |
| 2007/0084337 | A1 * | 4/2007 | Strassgurtl et al. | 89/36.08 |

(Continued)

FOREIGN PATENT DOCUMENTS

| | | | |
|---|---|---|---|
| DE | 101 34 394 | A1 | 1/2003 |
| DE | 10 2007 005707 | A1 | 8/2007 |

(Continued)

OTHER PUBLICATIONS

PCT, International Search Report, International Application No. PCT/DE2011/075081, mailed Oct. 6, 2011.

*Primary Examiner* — Gabriel Klein
(74) *Attorney, Agent, or Firm* — Thompson Hine LLP

(57) ABSTRACT

A floor pan of a vehicle, in particular an armored military vehicle, includes a first, lateral floor wall (1); a second, floor wall which is connected via connecting point (9) with the first, lateral wall (1); and an auxiliary armoring (4) releasably attached to the lateral floor wall (1) for mine protection. The auxiliary armoring is an armored plate that at least partially covers the second, floor wall (5) adjacent the lateral floor wall (1) and the connecting point (9) lying therebetween.

13 Claims, 2 Drawing Sheets

(56) References Cited

U.S. PATENT DOCUMENTS

| | | | | |
|---|---|---|---|---|
| 2011/0138994 | A1* | 6/2011 | Joynt et al. | 89/36.08 |
| 2012/0103177 | A1* | 5/2012 | Coltrane | 89/36.02 |
| 2012/0174767 | A1* | 7/2012 | Naroditsky et al. | 89/36.08 |
| 2012/0180632 | A1* | 7/2012 | Hunn et al. | 89/36.02 |
| 2012/0186428 | A1* | 7/2012 | Peer et al. | 89/36.02 |
| 2012/0247315 | A1* | 10/2012 | Treadway et al. | 89/36.02 |
| 2012/0255428 | A1* | 10/2012 | Allor et al. | 89/36.02 |
| 2013/0036899 | A1* | 2/2013 | Tucker | 89/36.02 |
| 2013/0312595 | A1* | 11/2013 | Lee | 89/36.02 |
| 2013/0319215 | A1* | 12/2013 | Parida et al. | 89/36.02 |
| 2014/0060303 | A1* | 3/2014 | Enck | 89/36.02 |

FOREIGN PATENT DOCUMENTS

| | | | | |
|---|---|---|---|---|
| EP | 1182420 | A1 * | 2/2002 | F41H 7/04 |
| EP | 1182421 | A1 * | 2/2002 | F41H 7/04 |
| GB | 2500805 | A1 * | 2/2013 | F41H 7/04 |
| WO | 2008/127272 | A1 | 10/2008 | |

* cited by examiner

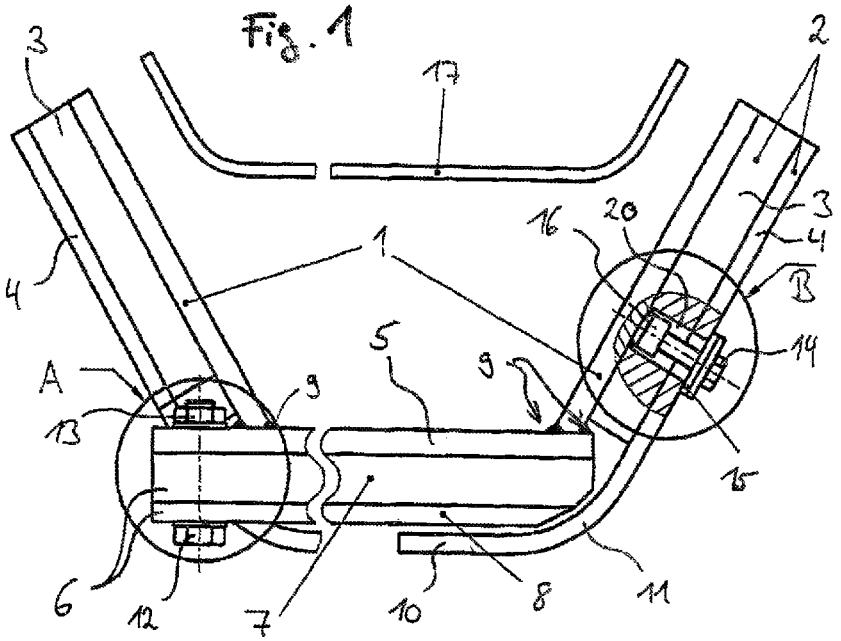
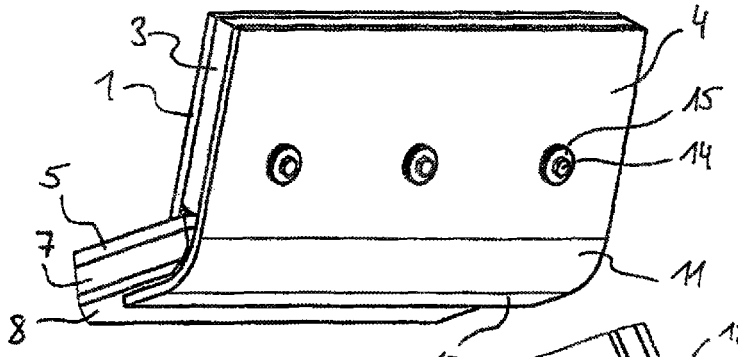
Fig. 2
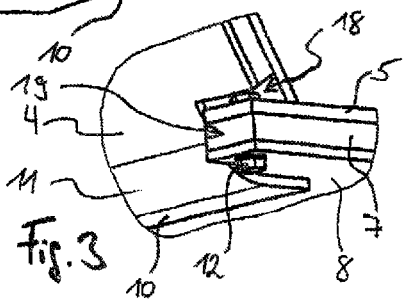
Fig. 3

VEHICLE FLOOR PAN COMPRISING AUXILIARY ARMORING

BACKGROUND OF THE INVENTION

The instant application should be granted the priority date of Apr. 23, 2010, the filing date of the corresponding German patent application 10 2010 016 605.7, as well as Apr. 15, 2011, the filing date of the International patent application PCT/DE2011/075081.

The present invention relates to a floor pan of a vehicle, in particular an armored military vehicle, with a lateral floor wall, which is connected via a connecting point with a second floor wall.

Military vehicles frequently have an armored floor pan, in which the passenger chamber of the vehicle is arranged. The lower portion of the vehicle pan can be formed by the floor pan, in particular with a V-shaped or U-shaped cross section. Also, an auxiliary floor pan can be arranged under the vehicle pan.

Each wall of this floor pan can be designed as a floor wall, so that the floor pan with a V-shaped cross section includes two lateral floor walls or with a U-shaped cross section includes two lateral floor walls and a lower floor wall. The connection of the floor walls takes place in particular by welding. The vehicle pan and/or the floor pan frequently comprises armored steel plates, so that in the region of the lateral walls in particular the vehicle pan is also provided with protection against ballistics.

A particular threat is represented by mine explosions or other explosive effects, which can act on the bottom or the sides on the floor pan. For this reason, it is known to reinforce the floor pan with auxiliary protective plates. However, these plates cannot be designed to be arbitrarily heavy, since the mobility of the vehicle and the transportation capability of the vehicle should be limited only so much as necessary.

DE 101 34 394 B4 describes a U-shaped floor pan, with which the lower floor wall, embodied as a floor plate, is welded with lateral floor walls. A flange plate is disposed on the pan lateral wall for receiving a support shaft bearing housing, which has recesses through which the floor plate can engage. The flange plate has a strong constructed based on its support function in the vehicle and is welded with the lateral floor wall. In the region of the lower floor wall, it also has an end region that overlaps the connecting point, which in turn is welded with the lower floor wall. A disadvantage of the known embodiment of the floor pan is that with an explosion that comes at an incline or from below, a tearing of the lower floor wall in the welded regions is possible, since based on the heat effects existing during welding, in general, a structural change occurs.

SUMMARY OF THE INVENTION

The invention has the object of better protecting the floor pan of a vehicle from the effects of explosions taking into consideration the vehicle transportation capability.

The invention solves this objection with the features from the independent patent claims. Advantageous further embodiments are the subject matter of the dependent claims.

With a first inventive solution, an auxiliary armoring for protection against is releasably attached to a lateral floor wall of the floor pan, in particular an armored plate, which at least partially covers the second floor wall adjacent the lateral floor wall and the connecting point lying therebetween. The second floor wall in this connection can represent a lower floor wall or a further lateral floor wall of the floor pan depending on the cross sectional profile of the floor pan.

The attachment of the auxiliary armoring can be realized via attachment means. For example, the auxiliary armoring can have a bore, through which a screw is guided, which is screwable into a threaded button arranged on the lateral floor wall.

An advantage of an auxiliary armoring releasably attached to the lateral floor wall is that it can be retrofit to older vehicles, and further, for reasons of weight reduction, for example, during transport of the vehicle in trains or aircraft, it is removable so that permissible transport maximum weights and loading specifications can be maintained.

In addition, it has been shown that the connecting points between the lateral floor wall and the second floor wall represent a weak point of the floor pan with the effects of an explosion, for example with a mine explosion. For this reason, the auxiliary armoring is embodied such that the connecting point and a part of the adjacent second floor wall are at least partially covered by it.

Particularly advantageous is that the auxiliary armoring is not connected with the second floor wall, in particular a lower floor wall. In particular, a welding between the auxiliary armoring and second floor wall should be avoided. Furthermore, also no screwing of the auxiliary armoring with the second floor wall takes place, so that the lower floor wall, which naturally is exposed to most of the effects of a mine explosion, is formed to be as homogenous and unaffected as possible.

In most cases, the lateral floor wall is positioned at an angle to the second floor wall. In this case, the auxiliary armoring can be embodied in the region of the connecting point to be correspondingly bent or angled. In an advantageous manner, the auxiliary armoring in the region of the lateral floor wall runs parallel to the lateral floor wall, and in the region of the second floor wall, runs parallel to the second floor wall.

The lateral floor wall can be welded with the second floor wall, whereby in this case, the auxiliary armoring at least partially covers the welding seam, in particular completely.

An increased protection can be achieved further in that between the lateral floor wall and the auxiliary armoring, an auxiliary protective layer or multiple protective layers can be arranged, which are connected fixedly with the auxiliary armoring in a sandwich-like manner. The auxiliary armoring therefore forms with the auxiliary protective layer a lateral auxiliary protective module, which is attachable to the vehicle as a component in the event of an emergency. Such a mine protection device with multiple layers, which is useable with both of the present inventions, is disclosed for example in DE 197 34 950 C2.

The lateral auxiliary protective module can be embodied in this regard in that the auxiliary protective layer does not cover the connecting point at least in partial regions. The auxiliary protective module specifically serves for protection of the lateral floor wall, so that it is sufficient for protection of the connecting point if merely the outer auxiliary armoring covers the connecting point in a clamp-like manner.

Particularly advantageous is the arrangement of an intermediate floor wall in the floor pan at a distance from the floor wall. This can represent the inner floor of the vehicle. By means of the spacing, a decoupling of the vehicle's inner floor from the pan floor exists, so that an improved protection against mines is provided.

An increased protection further is achieved in that on the second, in particular, lower floor wall, if necessary a second, in particular, lower auxiliary protective module is provided, which can be structured as multi-layered.

Preferably, the second auxiliary protective module is releasably attached to the second floor wall, preferably screwed, in order to retain the modularity of the auxiliary protection. In order to maintain the second floor wall, in particular the lower pan floor, as unaffected as possible, the second floor wall and the auxiliary protective module can be elongated in the region of the attachment of a projection formed over the connecting point between the second floor wall and first, lateral floor wall, whereby the attachment point lies in this projection. The attachment of the second auxiliary protective module on the second floor wall therefor takes place in this projection and therefore, in a non-critical region. Preferably, the auxiliary armoring of the lateral floor wall has a recess, through which the projection of the second floor wall and of the auxiliary protective module can extend.

Particularly advantageous is the attachment of the auxiliary armoring on the lateral floor wall by a screw connection, since this permits a quick mounting and demounting of the auxiliary armoring on the vehicle floor wall. The screw connection can contain a damping element, for example an elastic ring or a buckling sleeve, in particular made of metal.

With a particular advantageous embodiment, an auxiliary armoring is disposed on two opposite lateral floor walls of the vehicle floor pan, respectively, which are connected to one another via at least one bracket extending over the lower floor wall. Such mine-protection brackets can be embodied, such that the end regions of the auxiliary armoring covering the lower floor wall are elongated on one another and then connected to one another, whereby one or more closed brackets are provided and the protective capability is increased.

An inventive auxiliary armoring for a floor pan of vehicle, in particular an armored military vehicle, is therefore embodied such that it is provided with an attachment means for attaching the floor pan to a lateral floor wall, whereby by means of this attachment means, a connecting point between a lateral floor wall and a second adjacent floor wall is at least partially coverable. In a simple case, the attachment means of the auxiliary armoring represents a bore, through which a screw can be guided.

With a second inventive solution, an auxiliary protective module is releasably attached to a lower floor wall, in particular screwed, whereby the lower floor wall and the auxiliary protective module are elongated in the region of the attachment of a projection formed over the connection point between the lower floor wall and the lateral floor wall, whereby the attachment point is located in this projection. In this manner, the second floor wall, in particular, the lower pan floor can be maintained to be as unaffected as possible.

Preferably, an auxiliary armoring for mine protection, in particularly an armored plate, is releasably attached to the lateral floor wall, the armored plate having a recess, through which the projection extends. The lower auxiliary protective module preferably is multi-layered.

Also the embodiment described in connection with the first invention can find used with the second invention. Both solutions can be combined with one another as desired.

BRIEF DESCRIPTION OF THE DRAWINGS

An advantageous embodiment is described with reference to FIGS. 1 through 4. The figures show:

FIG. 1 shows a vehicle floor pan in a cross-sectional representation;

FIG. 2 shows a partial region of the floor pan according to FIG. 1 in a perspective representation;

FIG. 3 shows the region designated with "A" in FIG. 1 in a perspective representation.

DESCRIPTION OF SPECIFIC EMBODIMENTS

Figure 4:
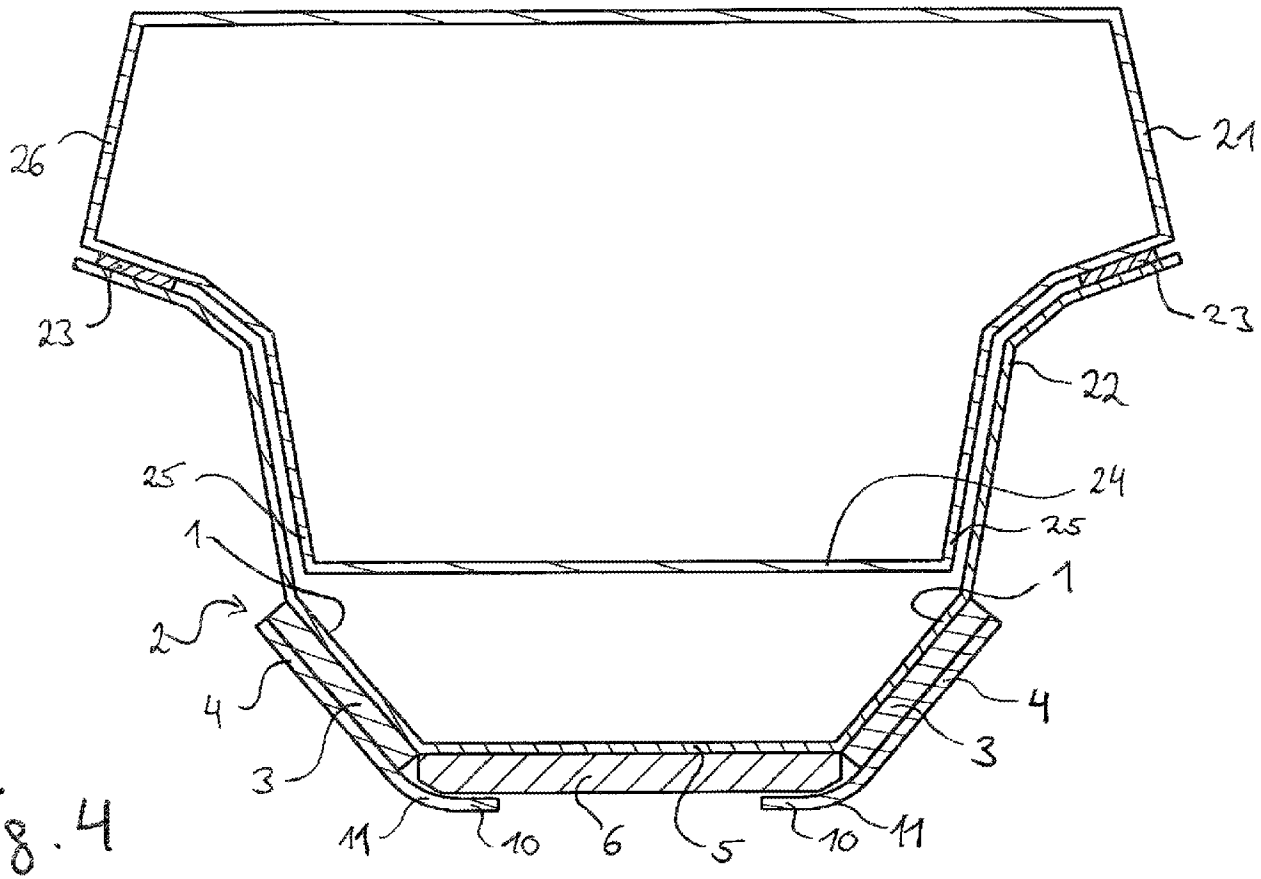
FIG. 4 shows a military vehicle in cross section in schematic representation.

FIG. 1 shows a floor pan with a U-shaped cross section from an armored steel plate of a vehicle with two opposite lateral floor walls 1 and a lower floor wall 5 welded with these walls via connecting points 9. For reasons relating to mine protection, the vehicle has an intermediate floor 17, which is spaced and decoupled from the floor pan floor 5.

For increasing protection against the effects of an explosion, the floor pan, with a relatively minimal base weight, is provided with auxiliary protective modules 2, 6. Lateral auxiliary protective modules 2 for protection from mines are releasably attached to the vehicle side walls 1, the auxiliary protective modules 2 being embodied in a sandwich-type manner and made up from an auxiliary armoring 4 formed as an armored plate and an auxiliary protective layer 3 between the lateral floor wall 1 and the auxiliary armoring 4.

The lateral auxiliary protective modules 2 according to FIG. 2 are releasably connected via multiple screw connections 14 with the lateral floor walls 1. In this regard, threaded buttons 16 are welded onto the lateral floor walls 1 from the outside (see partial sectional area B in FIG. 1), into which screws 14 can engage through corresponding recesses as attachment means 20 of the lateral auxiliary protective modules 2. An elastic ring 15 is inserted between the screw head 14 and the auxiliary armoring 4 as a damping element, in order to produce a damped connection point. In the event a welding seam 9 tears based on a related shock effect of a mine explosion, the plates that are knocked upwards are held by these damped connection points and cannot penetrate into the inner chamber floor. The damping elements 15 could also be formed as thin-walled metal sleeves, which are pressed back with the shock effects by buckling and therewith, achieve a damping effect.

The massive buttons 16 are welded to the walls 1, so that in the event that the welding seam 9 tears the floor structure by a shock effect, a holding effect occurs that prevents penetration of the torn floor sheet upwardly in the direction of the personnel chamber.

In addition, the lower floor wall 5 is provided with a lower auxiliary protective module 6. This second, lower auxiliary protective module 6 has essentially the same structure as the first, lateral auxiliary protective module 2. It comprises an armored plate 8 and an intermediate layer 7 arranged between the armored plate 8 and the lower floor wall 5.

Possible weak points of the floor pan are the connecting points 9 between the lower floor wall 5 and the lateral floor walls 1. In order to achieve here an increased level of protection, the auxiliary armoring 4 is embodied, respectively, such that it is attached to the lateral floor wall 1, but also is constructed such that they at least partially cover the connecting points 9 and the second, that is, lower floor wall 5 adjacent thereto. The auxiliary armoring 4, which runs substantially parallel to the lateral floor wall 1, has a bent region 11, on which an end region 10 terminates, which runs parallel to the lower floor wall 5. By means of this clamp-type structure, the auxiliary armoring 4 and the overlapping regions 10, 11, the forces of a mine explosion acting on the connecting points 9 can be better distributed. The auxiliary screwed protective modules 2, 6, therefore can also reduce loads on the welding connections 9 of the pan structure. With a pure welding construction, an adjacent component would also be claimed automatically with a deformation of a component, providing thereby a risk of the failure of the welding seam.

The auxiliary armoring 4 is not welded or screwed with the second floor wall 5 or the second auxiliary protective module 6. Thus, the floor plate 5 can be as unaffected as possible.

For this reason, also the lower auxiliary protective module 6 is attached releasably in a particular manner with the lower floor wall 5. The lower floor wall 5 and the lower auxiliary protective module 6 have corresponding projections 19, which are useable as fastening clips The projections 19 lie outside of the actual protected area, that is, they do not lie in the region between the opposite lateral floor walls 1, but are displaced outwardly. The attachment points of the lower auxiliary protection module 6 on the lower floor wall 5 lies from then on in the region of these projections 19, whereby in this regard, according to FIG. 3, a bore is formed through the lower floor wall 5 and the layers 7 and 8, through which a screw 12 with a cooperating nut 13 is insertable.

By means of the attachment projections 19, the advantage is offered that in the central region of the lower floor wall 5, no limitation of the floor freedom by attachment elements occur, for example, screw heads, and no buttons also must be welded there.

The lateral auxiliary protective modules 2 have a corresponding recess 18 in the region of the projections 19, through which the attachment ears 19 extend.

FIG. 4 shows a military vehicle without driving components, which has a closed vehicle pan 21 with lateral walls 26 and a floor 24 for receiving solders or equipment. An auxiliary floor pan 22 is arranged under the vehicle pan 21 from armored steel, whereby the floor pan 22 is connected via damping elements 23 with the vehicle pan 21. The floor pan 21 has two lateral floor walls 1 and a lower floor walls 5, which according to FIGS. 1 through 3, is equipped with lateral auxiliary protective modules 2 and a lower auxiliary protective module 6.

It should be noted that the invention is not limited to the auxiliary arrangement of the floor pan beneath the vehicle pan. As a floor pan in the sense of the present invention, also the lower end of the vehicle pan 24 is to be understood, comprising a floor wall 24 and floor lateral walls 25.

The invention can be used in an analogous manner also with V-shaped floor pans.

The specification incorporates by reference the disclosure of DE 10 2010 016 605.7 was filed Apr. 23, 2010 as well as International application PCT/DE2011/075081 filed Apr. 15, 2011. The present invention is, of course, in no way restricted to the specific disclosure of the specification and drawings, but also encompasses any modifications within the scope of the appended claims.

REFERENCE NUMERALS

1 lateral floor wall
2 lateral auxiliary protective module
3 auxiliary protective layer
4 auxiliary armoring
5 lower floor wall
6 lower auxiliary protective module
7 auxiliary protective layer
8 auxiliary armoring
9 connecting point
10 end region of the auxiliary armoring
11 bent region of the auxiliary armoring
12 screw
13 screw nut
14 screw
15 damping element
16 threaded button
17 intermediate floor
18 recess of the lateral auxiliary protective module
19 projection
20 attachment means of the lateral auxiliary protection module
21 vehicle pan
22 floor pan
23 damping element
24 floor of the vehicle pan
25 floor side wall
26 vehicle pan lateral wall

The invention claimed is:

1. A floor pan of a vehicle, the floor pan comprising:
a first, lateral floor wall;
a second, floor wall which is connected via a connecting point with the first, lateral floor wall, the first, lateral floor wall and the second, lower floor wall forming a protected area;
an auxiliary armoring releasably attached to the first, lateral floor wall for mine protection, wherein the auxiliary armoring includes an armored plate that at least partially covers the second, floor wall adjacent the first, lateral floor wall and the connecting point lying therebetween;
a second auxiliary protective module releasably attached to the second, floor wall, wherein the second, floor wall and the second auxiliary protective module are elongated outside of the connecting point of the second, floor wall and the lateral floor wall and form a projection having an attachment ear that lies outside of the protected area wherein an attachment point between the second auxiliary protective module and the second, floor wall is located in the attachment ear of the projection, and wherein the auxiliary armoring has a recess through which the attachment ear of the projection extends.

2. The floor pan according to claim 1, wherein the auxiliary armoring is not connected to the second, floor wall.

3. The floor pan according to claim 1, wherein the auxiliary armoring is bent or angled in the region of the connecting point.

4. The floor pan according to claim 1, wherein the first, lateral floor wall is welded to the second, floor wall, wherein the auxiliary armoring covers the welding seam.

5. The floor pan according to claim 1, wherein one or more auxiliary protective layers are arranged between the first, lateral floor wall and the auxiliary armoring, which are connected fixedly to the auxiliary armoring.

6. The floor pan according to claim 5, wherein the one or more auxiliary protective layers only partially covers the connecting point.

7. The floor pan according to claim 1, wherein the second auxiliary protective module is multi-layered.

8. The floor pan according to claim 1, wherein the second auxiliary protective module is screwed into the second, floor wall.

9. The floor pan according to claim 1, further comprising a screw connection attaching auxiliary armoring to the first, lateral floor wall.

10. The floor pan according to claim 9, wherein the screw connection contains a damping element.

11. The floor pan according to claim 10, wherein the damping element is selected from an elastic ring and a buckling sleeve.

12. The floor pan according to claim 1, further comprising two opposite ones of the first, lateral floor wall, wherein the auxiliary armoring is attached to the two opposite ones of the first, lateral floor wall, and wherein the protected area is a region between the two opposite ones of the first, lateral floor wall.

13. The floor pan according to claim 1, wherein the vehicle is an armored military vehicle.

* * * * *